United States Patent [19]

Dahlander et al.

[11] Patent Number: 4,830,601

[45] Date of Patent: May 16, 1989

[54] METHOD FOR THE CONTROL OF A BURNER EQUIPPED WITH AN INJECTOR NOZZLE AND AN ARRANGEMENT FOR EXECUTING THE METHOD

[76] Inventors: Pär N. O. Dahlander, Kamrersvägen 41, S-237 00 Bjärred; Carl H. Tyrén, Majorsgatan 9, S-211 41 Malmö, both of Sweden

[21] Appl. No.: 84,030

[22] Filed: Aug. 10, 1987

[51] Int. Cl.[4] ..... F23H 5/08

[52] U.S. Cl. ..... 431/12; 431/13; 431/14; 431/79

[58] Field of Search ..... 431/76, 79, 12, 13, 431/14

[56] References Cited

U.S. PATENT DOCUMENTS

| | | | |
|---|---|---|---|
| 3,280,882 | 10/1966 | Hemker . | |
| 3,299,841 | 1/1967 | Hemker et al. . | |
| 3,486,835 | 12/1969 | Grobe . | |
| 3,825,397 | 7/1974 | Johansson et al. | 431/79 |
| 4,043,742 | 8/1977 | Egan et al. . | |
| 4,461,170 | 7/1984 | Suzuki et al. . | |
| 4,547,145 | 10/1985 | Jahnke | 431/79 |
| 4,595,353 | 6/1986 | de Haan | 431/79 |
| 4,653,998 | 3/1987 | Sohma et al. | 431/79 |

FOREIGN PATENT DOCUMENTS

| | | |
|---|---|---|
| 126138 | 6/1973 | Denmark . |
| 1451624 | 8/1963 | Fed. Rep. of Germany . |
| 1221755 | 7/1966 | Fed. Rep. of Germany . |
| 1551989 | 11/1967 | Fed. Rep. of Germany . |
| 1816397 | 8/1969 | Fed. Rep. of Germany . |

*Primary Examiner*—Carroll B. Dority, Jr.
*Attorney, Agent, or Firm*—Merchant, Gould, Smith, Edell Welter & Schmidt

[57] ABSTRACT

Method for the control of a burner equipped with an injector nozzle, said method comprising the steps of continuously during combustion optically monitoring the flame of the burner; subjecting the light from the burner to spectral analysis for determining the instantaneous value of the air factor in the combustion gases, and controlling the supply of fuel and/or combustion air to the burner in dependence of said instantaneous value of the air factor. The method is characterized in that light emitted from the central portion of the flame which penetrates through the nozzle opening through which fuel is injected into the combustion chamber is picked up in a point situated in the immediate vicinity of, behind and axially with said nozzle opening, said light being further conducted out of the nozzle for being subjected to spectral analysis. The invention also relates to an arrangement for carrying out the method, comprising a burner equipped with an injector nozzle having a nozzle opening through which fuel is injected into the combustion chamber. Means are arranged within the burner in immediate vicinity of, behind and axially with the nozzle opening, said means being adapted to continuously pick up light which penetrates through said nozzle opening from the central portion of the flame, said means further conducting said light out of the injection nozzle to a device for subjecting said light to spectral analysis.

5 Claims, 2 Drawing Sheets

METHOD FOR THE CONTROL OF A BURNER EQUIPPED WITH AN INJECTOR NOZZLE AND AN ARRANGEMENT FOR EXECUTING THE METHOD

The present invention relates to a method for the control of a burner equipped with an injector nozzle through optical monitoring of the flame from the burner and regulation of the supply of fuel and/or oxygen to the burner depending on the presence or absence of light from the flame and/or depending on the value of the air factor in the combustion gases which is determined by spectral analysis of light from the flame, and an arrangement designed for carrying out the method.

In combustion plants of various kinds optical monitoring of the flame from the burner is a frequently used method for checking the function of the burner and for regulating the supply of fuel and/or air, that is to say oxygen to the burner. According to the most simple application of optical flame monitoring only the presence or absence of light from the flame is detected, in conjunction with which the supply of fuel to the burner nozzle is interrupted when the radiation of light from the flame ceases or is drastically reduced. In more advanced systems light from the flame is subjected to spectral analysis in order thereby obtain data relating to the actual value of the air factor in the combustion gases, and to compare the actual value with a predetermined reference value. Any different between the actual value and the reference value then causes a control signal to be generated for the purpose of regulating the supply of fuel and/or air, that is to say oxygen, to the burner, as that the desired air factor is maintained continuously-during combustion.

Previously disclosed systems of this kind are based on the fact that the radiation given off by the flame contains data in respect of the composition of the gases present in the combustion gases. Various substances or compounds, such as $O_2$, $CO_2$ and $H_2$, etc., which are present in the combustion gases in the flame, will thus produce radiation, the intensity of which differs noticeably from the radiation intensity in general within certain wave ranges which are characteristic of the substance or compound in question and which are also dependent on the content of the substance or compound in question. Stoichiometric combustion thus produces a spectrum which can be shown by spectral analysis of the luminous radiation from the flame to be characteristic of this state. Combustion in a state of excess air or in a state of insufficient air will produce corresponding spectra which are characteristic of these states. With the help of the data obtained by spectral analysis of the luminous radiation from the flame, it is possible to calculate the instantaneous value of the air factor and to compare this with a predetermined reference value in a comparator. The difference between the actual value and the reference value can then be caused to generate a control signal for the control of the supply of fuel and/or air to the burner so that the air factor can be maintained continuously at the predetermined value. A previously disclosed system of this kind is described in U.S. Pat. No. 4,043,742.

To obtain a reliable result by the method described above, certain conditions must, however, be present. Thus, one must be certain that the light which is to be processed by spectral analysis actually originates from the flame of the burner, and not from other sources of radiation, such as an adjacent burner, or from the walls of the combustion chamber. it is also particularly important that the detected luminous radiation should not be exposed prior to spectral analysis to any influence of such a kind as will cause its character to alter, for example by filtering or in some other way.

One feature which is shared by the previously disclosed systems for the optical monitoring of the flame is that the flame is observed through an orifice or a window in the wall of the combustion chamber. Arranged in the wall is a channel which is directed towards the flame and through which light from the flame can find its way out to be received or detected by means provided for this purpose. The channel or orifice is also provided with a window made of a transparent, heat-resistant material in order to protect the means used for detection against the influence of the high temperatures prevailing in the combustion chamber.

Monitoring of the flame through an orifice or a channel in the wall of the combustion chamber involves certain disadvantages, however, which have a negative effect on the reliability of the intended detection of light from the flame of the burner. As a consequence of the positioning of the orifice or the channel in the wall of the combustion chamber opposite or beside the burner, it is not possible to prevent luminous radiation from the walls of the combustion chamber from penetrating into the orifice or channel to a certain extent and being detected. If several burners are arranged in the combustion chamber, it can hardly be avoided that luminous radiation from an adjacent burner also to a certain extent penetrates into the detection opening or the channel for a particular flame. The protective window which closes off the orifice or channel will take on a coating of combustion products on the side facing the combustion chamber after only a short period of use, and this coating will act as a filter for the luminous radiation which is detected in the orifice or channel. These factors can thus cause the light which is detected to produce a false picture of the state existing in the flame. Control of the burner based on spectral analysis of light which is subjected in the abovementioned manner to irrelevant influences is thus likely to be defective to a corresponding degree.

The object of the present invention is to make available a method for the control of a burner of the kind indicated in the introduction, in which the disadvantages described above associated with the previously disclosed systems are avoided, and in which the influence of luminous radiation from adjacent burners or from the walls of the combustion chamber is minimized and the light picked up from the flame represents in a reliable fashion the conditions of combustion existing in the flame at the time of interception. An object of the invention is also to make available a method which is suitable not only for the simple optical monitoring of the flame and for the regulation of the fuel supply depending on the presence or absence of light from the flame, but also for the more advanced, continuous control of the supply of fuel and/or oxygen to the burner depending on the instantaneous value of the air factor in the combustion gases which is determined by spectral analysis of light from the flame.

A further object of the present invention is to make available an arrangement for the execution of the method which is of simple construction and in which the orifice via which the light from the flame is picked up automatically is kept free of deposits which could otherwise affect the quality of the said light, at the same time continuously cooling the means which are used to pick up the light.

The objects described above are achieved by a method and an arrangement whose special characteristics are indicated in the following Patent Claims.

The invention is described below in relation to illustrative embodiments shown in the accompanying drawings, in which.

Figure 1:
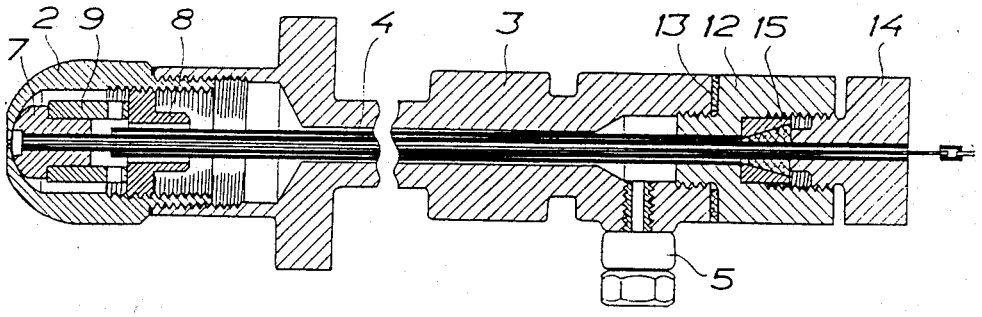
FIG. 1 shows a longitudinal section through an injector nozzle included in the arrangement in accordance with the invention and designed in accordance with the invention.

In the method in accordance with the invention a burner equipped with an injector nozzle is controlled by the flame produced by the burner being monitored optically by intercepting the light from the flame. The intercepted light can be caused to actuate a photoelectric cell, which, depending on the presence or the absence of light, can be caused to generate a control signal for regulating the supply of fuel to the burner. Since the intercepted light contains data in respect to the conditions of combustion existing at the time of detection, the intercepted light is preferably subjected to spectral analysis in order thereby to obtain an instantaneous value for the air factor in the combustion gases, which is then compared with a predetermined reference value, in conjunction with which any difference between the actual value and the reference value can be caused to generate a control signal for the control of the supply of fuel and/or air, that is to say oxygen, to the burner, so that the desired reference value for the air factor is achieved. The method in accordance with the invention is characterized in that the light, which finds its way from the flame through the orifice in the injector nozzle via which fuel is injected, is detected. A number of advantages are achieved through this simple measure. The interception of the light from the flame thus takes place in the immediate vicinity of the flame, and this situation is in itself intended to reduce the risk of any undesired influence on the light from the flame which is to be detected. The fact that interception takes place from inside the nozzle eliminates or reduces to a considerable degree the risk of the luminous radiation being influenced by adjacent burners or by the hot walls of the combustion chamber. Thanks to the fact that interception takes place inside the injector nozzle, the need for a protective window between the flame and the point of detection no longer exists, since the fuel forms a protective film which is constantly being renewed, which eliminates the risk of deposits which could otherwise produce a negative effect on the quality of the detected light.

The method in accordance with the invention is illustrated further in the following description of an arrangement for the execution of the method illustrated in the Figures in the drawings.

Figure 2:
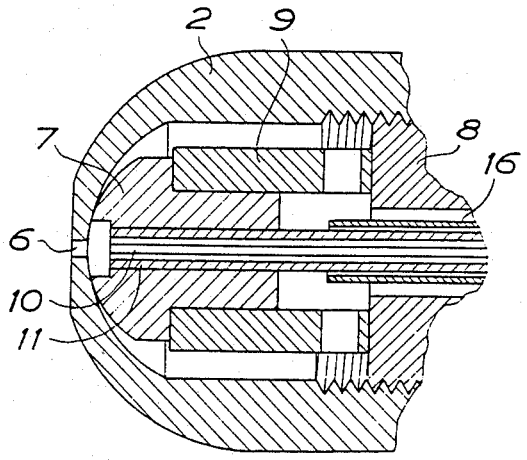
FIG. 2 shows on an enlarged scale a longitudinal section through the front part of the injector nozzle.
Figure 3:
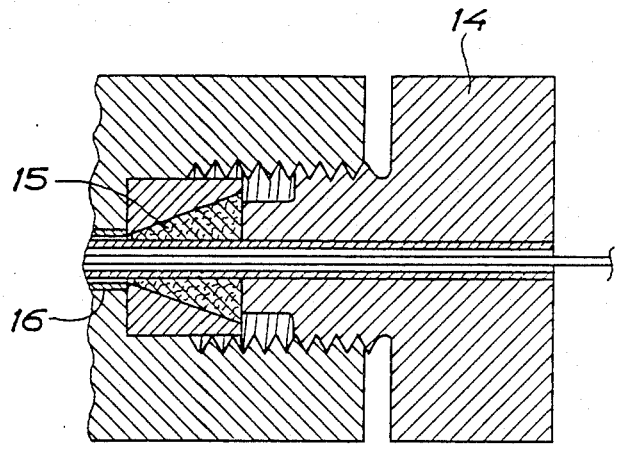
FIG. 3 shows on an enlarged scale a partial section through the rear end of the nozzle holder which supports the nozzle.

Illustrated in FIGS. 1–3 is an injector nozzle 2 for a burner 1, which nozzle 2 is included in an arrangement in accordance with the invention. The injector nozzle 2 is supported at one end by a nozzle holder 3 which consists of a tubular metal sleeve with an axial channel 4 through which fuel is supplied to the injector nozzle 2 installed at the front end of the nozzle holder. The channel 4 is supplied with fuel via a connection 5 for the supply of fuel arranged in the rear part of the nozzle holder. The injector nozzle 2 incorporates in a previously disclosed fashion a turborator 7 arranged inside the nozzle and directly in line with its nozzle orifice 6, said turborator being provided on its front surface with spiral guide strips. The turborator 7 is kept in contact with the spray nozzle under tension by means of a locking nut 8 and a sleeve 9 provided with radial holes. Between the turborator 7 and the spray nozzle 2 is formed a space through which the fuel is forced past the front surface of the turborator and out as a thin film through the nozzle orifice 6. In accordance with the invention the turburator is provided, directly in line with the nozzle orifice 6 in the injector nozzle 2, with an axial hole, into which is introduced a fibre-optic light conductor 10 which is appropriately enclosed within a tubular sleeve 11. The fibre-optic light conductor extends as far as the front surface of the turborator 7 and thus discharges directly inside the nozzle orifice 6 of the injector nozzle 2. The fibre-optic light conductor 10 with its protective sleeve 11 extends axially in a direction from the turborator 7 through the channel 4 of the nozzle holder 3 and then axially through an end terminal 12 screwed into the rear end of the nozzle holder 3, said end terminal forming a seal by means of a gasket 13 against the rear end of the nozzle holder 3, and then onwards out of the nozzle holder 3 through an end journal 14 which is capable of being screwed into the end terminal 12 whilst compressing a gasket 15 which sealing encloses the protective sleeve 11 for the fibre-optic filament 10. Also attached to the end terminal 12 is a protective tube 16 which extends coaxially with the fibre-optic filament 10 and its protective sleeve 11 as far as the front part of the nozzle holder 3. The purpose of the protective tube 16 is to facilitate the installation of the fibre-optic filament.

As fuel is supplied via the connection 5, the fuel flows onwards through the channel 4 of the nozzle holder 3, through the radial holes in the sleeve 9 and past the turborator 7, and is then sprayed out through the nozzle orifice 6 of the injector nozzle 2. The film of fuel which is sprayed out through the nozzle orifice 6 in this way constitutes a curtain of fuel across the end of the fibre-optic filament 10 and cools the latter. The fuel, which is sprayed out through the nozzle orifice 6 of the injector nozzle 2 at high pressure, prevents blocking of the nozzle orifice 6, which is thus kept open all the time and permits light from the flame to enter via the nozzle orifice 6 as far as the end of the fibre-optic filament 10. The light which has been received in this way is conveyed via the fibre-optic conductor 10 and out via the nozzle holder 3.

Figure 4:
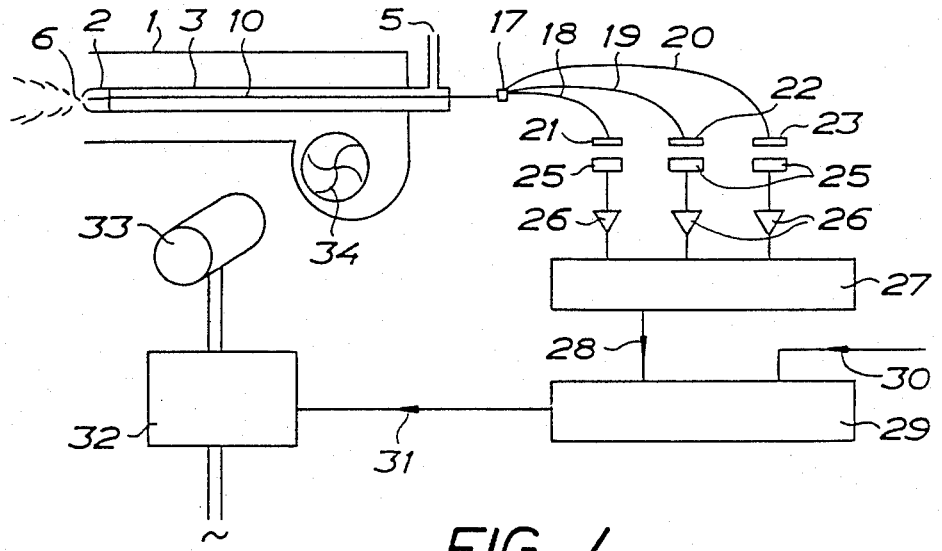
FIG. 4 illustrates schematically a basic circuit diagram of a control system for the control of a burner in accordance with the invention.

Shown in FIG. 4 is a basic circuit diagram for the application of the invention to the control of a burner utilizing the arrangement in accordance with the invention. Installed in the burner 1 is a spray nozzle 2 of the kind described above fitted to the nozzle holder 3 and comprising the fibre-optic light conductor 10 which discharges into the nozzle and extends out from the nozzle holder at its rear end. The nozzle holder 3 is connected via the connection 5 to a fuel supply line. Outside the nozzle holder 3 the fibre-optic filament 10 is connected to a fibre junction 17, in which the luminous beam from the fibre-optic filament 10 is divided up into three luminous beams of equivalent value, each of which is conveyed further in its own fibre-optic filament 18, 19 and 20, each of which discharges into its own filter 21, 22 and 23. The filters 21–23 are selected with appropriate characteristics to permit only light within a limited wave range to pass through. The wave ranges for the filters 21–23 are selected so that they represent three different wave ranges, each of which is characteristic of the luminous radiation which corresponds to a particular substance present in the combustion gases. The filter 21 can thus be selected so as to correspond to $CO_2$, the filter 22 to $O_2$, and the filter 23 to $H_2$. The light which has passed through each filter is then caused to actuate a photodetector 25, which via an amplifier 26 transmits a signal to a signal processing unit 27 in which is stored a control algorithm which, depending on the input signals, calculates the actual value of the air factor in the combustion gases and accordingly transmits an actual value signal 28 to a regulator in the form of a comparator 29. The actual value signal 28 is compared in the comparator 29 with a reference value signal 30 which has already been entered into it. Any difference between the actual value signal 28 and the reference value signal 30 causes the comparator 29 to generate an output control signal 31 to a speed controller 32 for the fan motor 33 of the fan 34. Depending on the character of the control signal 31 the fan speed is thus caused to increase or to reduce so as to increase and reduce respectively the supply of air to the burner 1, so that the continuously detected actual value for the air factor in the combustion gases is caused to agree with the reference value entered into the comparator. In the system illustrated in FIG. 4 the control signal 31 is caused to control the supply of air to the burner. It is, of course, possible to choose to cause the control signal 31 to control the supply of fuel instead.

The invention described above in relation to the illustrative embodiments shown in the drawings is not restricted to these, but can be modified within the scope of the following Patent Claims. Thus, instead of a single light conductor, it is possible to provide a number of fibre-optic light conductors 10, for example three light conductors, which extend into the nozzle enclosed within a sleeve 11, and which discharge inside the nozzle orifice 6. The need for a fibre junction 17 is avoided in this way; at the same time, the intensity of the light which is conducted to each of the filters 21, 22, 23 is three times as high as in the illustrative embodiment shown in FIG. 1.

We claim:

1. Method for the control of a burner (1) equipped with an injector nozzle (2) having a nozzle opening (6), said method comprising the steps of continuously during combustion optically monitoring the flame of the burner (1) and subjecting the light from the burner to spectral analysis for determining the instantaneous value of the air factor in the combustion gases, and controlling the supply of fuel and/or combustion air to the burner in dependence of said instantaneous value of the air factor characterized in that light emitted from the central portion of the flame which penetrates through the nozzle opening (6) through which fuel is injected into the combustion chamber is picked up in a point situated in the immediate vicinity of, behind and axially with said nozzle opening (6), said light being further conducted out of the nozzle (2) for being subjected to spectral analysis.

2. A burner arrangement comprising: a burner (1) equipped with an injector nozzle (2) having a nozzle opening (6) through which fuel is injected into a combustion chamber, characterized by means (10) arranged within the burner (1) in immediate vicinity of, behind and axially with the nozzle opening (6), said means being adapted to continuously pick up light which penetrates through said nozzle opening from the central portion of the flame, said means (10) further conducting said light out of the injection nozzle (2) to a device for subjecting said light to spectral analysis.

3. Arrangement as claimed in claim 2, characterized in that said means include a fibre-optic conductor (10) extending into said injector nozzle (2) and having its inner end positioned in the vicinity of, behind and axially with said nozzle opening (6).

4. Arrangement according to claim 3, characterized in that the fibre-optic light conductor (10) is connected outside the nozzle (2) to a fibre junction (17) in which the light transmitted in the fibre-optic light conductor (10) is divided up into a number of luminous beams of equal value.

5. Arrangement as claimed in claim 2, characterized in that said means include a plurality of fibre-optic conductors (10) extending in parallel into said injector nozzle (2) and having the inner ends positioned in the vicinity of, behind and axially with said nozzle opening (6).

* * * * *